US006938975B2

(12) United States Patent
King et al.

(10) Patent No.: US 6,938,975 B2
(45) Date of Patent: Sep. 6, 2005

(54) METHOD OF REDUCING PRINTING DEFECTS IN AN INK JET PRINTER

(75) Inventors: David Golman King, Shelbyville, KY (US); Patrick Laurence Kroger, Versailles, KY (US); Michael Anthony Marra, III, Lexington, KY (US); Randall David Mayo, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 47 days.

(21) Appl. No.: 10/647,867

(22) Filed: Aug. 25, 2003

(65) Prior Publication Data

US 2005/0046654 A1 Mar. 3, 2005

(51) Int. Cl.[7] ..... B41J 29/38; B41J 29/393
(52) U.S. Cl. ..... 347/16; 347/19
(58) Field of Search ..... 347/16, 19; 400/74, 400/582

(56) References Cited

U.S. PATENT DOCUMENTS 4,818,129 A 4/1989 Tanuma et al.
5,069,556 A 12/1991 Sasaki et al.
5,250,956 A 10/1993 Haselby et al.
5,289,208 A 2/1994 Haselby
5,297,017 A 3/1994 Haselby et al.
5,349,375 A 9/1994 Bolash et al.
5,397,192 A 3/1995 Khormaee
5,448,269 A 9/1995 Beauchamp et al.
5,451,990 A 9/1995 Sorenson et al.
5,561,449 A 10/1996 Raskin et al.
5,600,350 A 2/1997 Cobbs et al.
5,644,344 A 7/1997 Haselby
5,796,414 A * 8/1998 Sievert et al. ..... 347/19
5,918,991 A 7/1999 Miyasaka
5,975,679 A 11/1999 Nicoloff, Jr. et al.
5,995,713 A 11/1999 Lee
6,082,911 A 7/2000 Murakami
6,084,607 A 7/2000 Matsuda
6,086,181 A 7/2000 Majette et al.
6,109,721 A 8/2000 Kim
6,158,905 A 12/2000 Endo
6,161,914 A 12/2000 Haselby
6,193,350 B1 2/2001 Hadley
6,196,736 B1 3/2001 Otsuki et al.
6,241,334 B1 6/2001 Haselby
6,257,143 B1 7/2001 Iwasaki et al.
6,267,519 B1 7/2001 Otsuki et al.
6,297,888 B1 10/2001 Noyes et al.
6,302,506 B1 10/2001 Norton
6,312,082 B1 11/2001 Lund et al.
6,331,038 B1 12/2001 Boleda et al.
6,336,701 B1 1/2002 Hickman
6,347,856 B1 2/2002 Arquilevich et al.
6,353,481 B1 * 3/2002 Lee ..... 358/1.14
6,364,447 B1 4/2002 Boleda et al.
6,367,996 B1 4/2002 Edwards
6,390,588 B1 5/2002 Ikeda
6,416,148 B1 7/2002 Du et al.
6,425,652 B2 7/2002 Otsuki
6,431,775 B1 8/2002 Huang et al.
6,439,684 B1 * 8/2002 Yoshimura et al. ..... 347/19
6,450,611 B1 9/2002 Brown, Jr. et al.
6,478,401 B1 * 11/2002 King et al. ..... 347/19
6,494,558 B1 * 12/2002 Doval et al. ..... 347/19
6,527,359 B1 3/2003 Otsuki (Continued)

*Primary Examiner*—Thinh Nguyen
(74) *Attorney, Agent, or Firm*—Taylor & Aust, P.C.

(57) ABSTRACT

A method of reducing printing defects in an ink jet printer including at least one printhead mounted to a printhead carrier for printing on a print media sheet, includes the steps of determining a vertical alignment error for at least one printhead and adjusting a sheet feed increment for the print media sheet based on the vertical alignment error.

20 Claims, 8 Drawing Sheets

U.S. PATENT DOCUMENTS

| | | | | |
|---|---|---|---|---|
| 6,554,387 | B1 | 4/2003 | Otsuki | |
| 6,554,390 | B2 | 4/2003 | Arquilevich et al. | |
| 6,554,398 | B2 | 4/2003 | Wyngaert et al. | |
| 6,561,613 | B2 | 5/2003 | Cunnagin et al. | |
| 6,604,808 | B2 * | 8/2003 | King et al. | 347/19 |
| 2001/0017638 | A1 | 8/2001 | Otsuki | |
| 2002/0060709 | A1 | 5/2002 | Arquilevich et al. | |
| 2002/0186269 | A1 | 12/2002 | Endo | |
| 2003/0011792 | A1 | 1/2003 | Noyes et al. | |
| 2003/0063329 | A1 | 4/2003 | Kaneko et al. | |
| 2003/0067503 | A1 | 4/2003 | Cunnagin et al. | |
| 2003/0085937 | A1 | 5/2003 | Otsuki | |

* cited by examiner

METHOD OF REDUCING PRINTING DEFECTS IN AN INK JET PRINTER

BACKGROUND OF THE INVENTION

1. Field of the Invention

The present invention relates to an imaging apparatus, and, more particularly, to a method of reducing printing defects in an ink jet printer.

2. Description of the Related Art

A typical ink jet printer forms an image on a print media sheet by ejecting ink from a plurality of ink jetting nozzles of an ink jet printhead to form a pattern of ink dots on the print media sheet. Such an ink jet printer typically includes a reciprocating printhead carrier that transports one or more ink jet printheads across the print media sheet along a bi-directional scanning path defining a print zone of the printer. Typically, the mid-frame provides media support at or near the print zone. A sheet feeding mechanism is used to incrementally advance the print media sheet in a sheet feed direction, also commonly referred to as a sub-scan direction or vertical direction, through the print zone between scans in the main scan direction, or after all data intended to be printed with the print media sheet at a particular stationary position has been completed.

The reciprocating printhead carrier is supported, for example, by at least one guide rod. The printhead carrier includes a pair of axially spaced bearings having respective apertures for receiving the guide rod. One parameter that limits print quality in bi-directional printing is the carrier bearing clearance, i.e., the amount of clearance between the carrier bearings and the associated guide rod. Bearing clearance is necessary from a manufacturing tolerance perspective, and typically the tighter the tolerances the more expensive the printer. The effect of the bearing clearance is a shift in the registration position of the ink jet printhead with respect to a print area on the print media sheet. It has been observed that this shift occurs mainly in the vertical, i.e., print media advance, direction.

What is needed in the art is a method of reducing printing defects in an ink jet printer, such as for example, printing defects due to carrier bearing clearances.

SUMMARY OF THE INVENTION

The present invention relates to a method of reducing printing defects in an ink jet printer, such as for example, printing defects due to carrier bearing clearances.

The invention, in one form thereof, relates to a method of reducing printing defects in an ink jet printer including at least one printhead mounted to a printhead carrier for printing on a print media sheet. The method includes the steps of determining a vertical alignment error for at least one printhead; and adjusting a sheet feed increment for the print media sheet based on the vertical alignment error.

In another form thereof, the invention relates to a method of determining a vertical alignment error for a printhead. The method includes the steps of printing on a sheet of print media a plurality of blocks in a first pass in a first carrier scan direction, the blocks being spaced apart; printing on the sheet of print media a block on a second pass in a second carrier scan direction opposite to the first carrier scan direction, and positioned adjacent to one of the plurality of blocks printed in the first pass; advancing the sheet of print media by a predetermined advance distance, and recording a current location of the sheet of print media; printing on the sheet of print media a next block in the second carrier scan direction between two of the plurality of blocks printed in the first pass that were not previously printed between; and scanning a sensor across a pattern created by the printing of the plurality of blocks and the printing of the next block to collect data representing relative vertical positions of the blocks forming the pattern.

In still another form thereof, the invention relates to a method of determining a vertical alignment error for a printhead, including the steps of defining a vertical sheet feed direction; printing a first plurality of rectangular blocks in a first pass of the printhead in a first scanning direction, the first plurality of rectangular blocks being spaced apart, the first plurality of rectangular blocks being positioned to be parallel to the vertical sheet feed direction; printing a second plurality of rectangular blocks in a second pass of the printhead in a second carrier scan direction opposite to the first carrier scan direction, each of the second plurality of rectangular blocks being positioned adjacent respective ones of the first plurality of rectangular blocks, the second plurality of rectangular blocks being positioned to be parallel to the vertical sheet feed direction, the first plurality of rectangular blocks and the second plurality of rectangular blocks forming a first pattern; scanning the first pattern with a sensor to collect horizontal alignment data relating to a horizontal alignment of the first rectangular blocks in relation to the second rectangular blocks; printing a first plurality of slanted blocks in a third pass of the printhead in the first carrier scan direction, the first plurality of slanted blocks being positioned to be non-parallel to the vertical sheet feed direction, the first plurality of slanted blocks being spaced apart; printing a second plurality of slanted blocks in a fourth pass of the printhead in the second carrier scan direction, the second plurality of slanted blocks being positioned to be non-parallel to the vertical sheet feed direction, the first plurality of slanted blocks and the second plurality of slanted blocks forming a second pattern; scanning the second pattern with the sensor to collect composite alignment data relating to alignment of the first plurality of slanted blocks in relation to the second plurality of slanted blocks, the composite alignment data including both a horizontal alignment component and a vertical alignment component; and processing the composite alignment data and the horizontal alignment data to generate a vertical alignment value corresponding to the vertical alignment error.

BRIEF DESCRIPTION OF THE DRAWINGS

The above-mentioned and other features of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
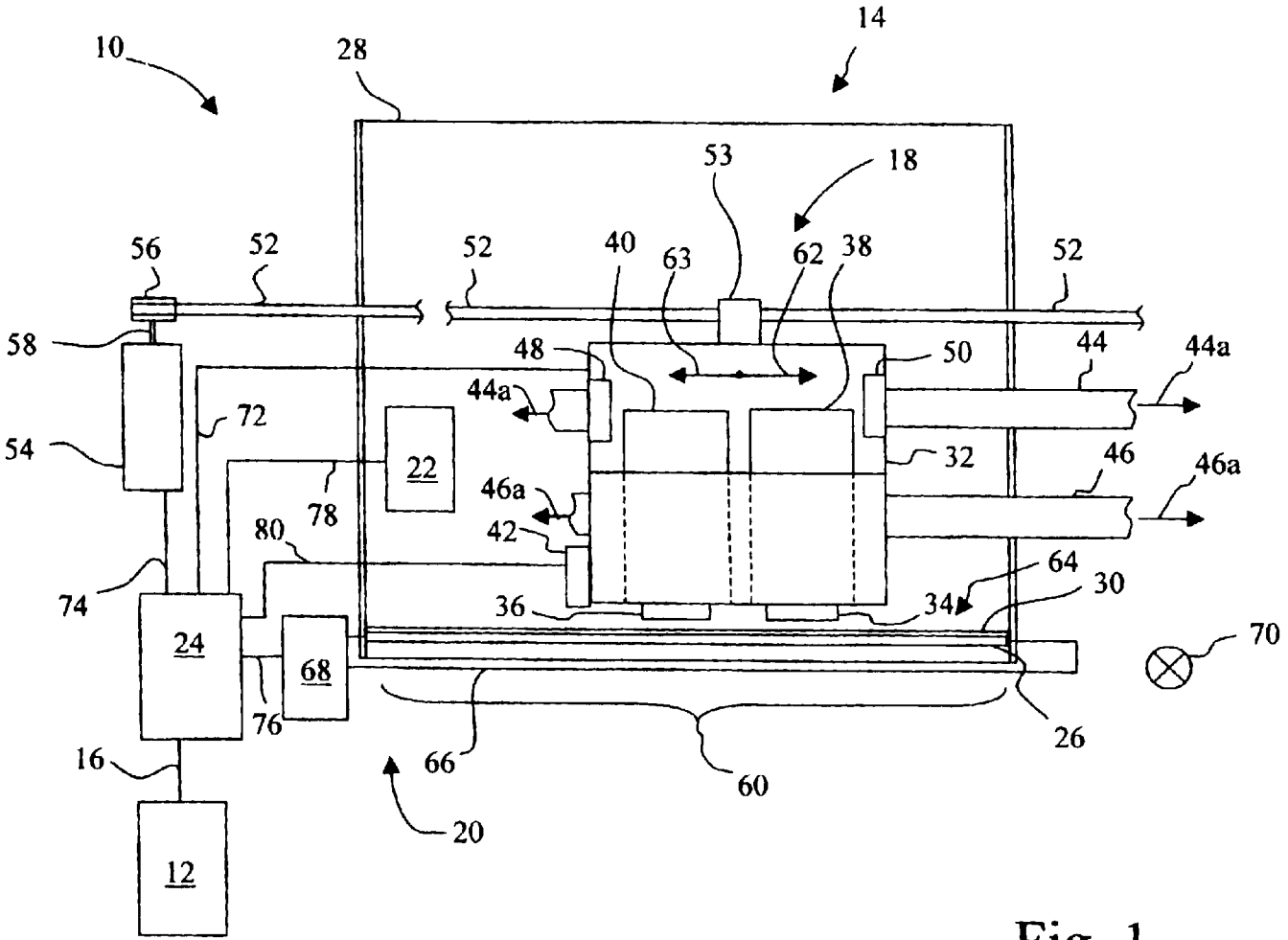
FIG. 1 is an imaging system embodying the present invention.

Referring now to the drawings, and particularly to FIG. 1, there is shown an imaging system 10 embodying the present invention. Imaging system 10 includes a host 12 and an imaging apparatus, in the form of an ink jet printer 14 as shown. Host 12 is communicatively coupled to ink jet printer 14 via a communications link 16. Communications link 16 may be, for example, a direct electrical or optical connection, or a network connection.

Ink jet printer 14 includes a printhead carrier system 18, a feed roller unit 20, a sheet picking unit 22, a controller 24, a mid-frame 26 and a media source 28.

Host 12 may be, for example, a personal computer including a display device, an input device (e.g., keyboard), a processor, input/output (I/0) interfaces, memory, such as RAM, ROM, NVRAM, and a mass data storage device, such as a hard drive, CD-ROM and/or DVD units. During operation, host 12 includes in its memory a software program including program instructions that function as a printer driver for ink jet printer 14. The printer driver is in communication with controller 24 of ink jet printer 14 via communications link 16. The printer driver, for example, includes a halftoning unit and a data formatter that places print data and print commands in a format that can be recognized by ink jet printer 14. In a network environment, communications between host 12 and ink jet printer 14 may be facilitated via a standard communication protocol, such as the Network Printer Alliance Protocol (NPAP).

Media source 28 is configured to receive a plurality of print media sheets from which an individual print media sheet 30 is picked by sheet picking unit 22 and transported to feed roller unit 20, which in turn further transports print media sheet 30 during a printing operation. Print media sheet 30 can be, for example, plain paper, coated paper, photo paper and transparency media.

Printhead carrier system 18 includes a printhead carrier 32 for mounting and carrying a color printhead 34 and/or a monochrome printhead 36. A color ink reservoir 38 is provided in fluid communication with color printhead 34, and a monochrome ink reservoir 40 is provided in fluid communication with monochrome printhead 36. Those skilled in the art will recognize that color printhead 34 and color ink reservoir 38 may be formed as individual discrete units, or may be combined as an integral unitary printhead cartridge. Likewise, monochrome printhead 36 and monochrome ink reservoir 40 may be formed as individual discrete units, or may be combined as an integral unitary printhead cartridge.

Printhead carrier system 18 further includes a printhead alignment sensor 42 attached to printhead carrier 32. Sensor 42 may be, for example, a unitary optical sensor including a light source, such as a light emitting diode (LED), and a reflectance detector, such as a phototransistor. The reflectance detector is located on the same side of a media as the light source. The operation of such sensors is well known in the art, and thus, will be discussed herein to the extent necessary to relate the operation of sensor 42 with regard to the present invention. For example, the LED of sensor 42 directs light at a predefined angle onto a reference surface, such as the surface of print media sheet 30, and at least a portion of light reflected from the surface is received by the reflectance detector of sensor 42. The intensity of the reflected light received by the reflectance detector varies with the density of a printed image present on print media sheet 30, and can be used to detect the absence or presence of a printed indicia on print media sheet 30. The light received by the reflectance detector of sensor 42 is converted to an electrical signal by the reflectance detector of sensor 42. The signal generated by the reflectance detector corresponds to an intensity of the light received, which may be used to indicate a relative position of a printed indicia with respect to sensor 42, and accordingly, may be translated to a position of printhead carrier 32 and/or printheads 34, 36, relative to the printed indicia.

Printhead carrier 32 is guided by a pair of guide rods 44, 46. Each of guide rods 44, 46 includes a respective horizontal axis 44*a*, 46*a*. Printhead carrier 32 includes a pair of guide rod bearings 48, 50, each of guide rod bearings 48, 50 including a respective aperture for receiving guide rod 44. Printhead carrier 32 further includes a glide surface (not shown) that is retained in contact with guide rod 46, for example, by gravitational force. The horizontal axis 44*a* of guide rod 44 generally defines a bi-directional scanning path for printhead carrier 32, and thus, for convenience the bi-directional scanning path will be referred to as bi-directional scanning path 44*a*. Accordingly, bi-directional scanning path 44*a* is associated with each of printheads 34, 36 and sensor 42.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 24, printhead carrier 32 is transported in a reciprocating manner along guide rods 44, 46. Carrier motor 54 can be, for example, a direct current (DC) motor or a stepper motor.

The reciprocation of printhead carrier 32 transports ink jet printheads 34, 36 across the print media sheet 30, such as paper, along bi-directional scanning path 44*a* to define a print zone 60 of inkjet printer 14. The reciprocation of printhead carrier 32 occurs in a main scan direction (bi-directional) that is parallel with bi-directional scanning path 44*a*, and is also commonly referred to as the horizontal direction, including a left-to-right carrier scan direction 62 and a right-to-left carrier scan direction 63. Generally, during each scan of printhead carrier 32 while printing, the print media sheet 30 is held stationary by feed roller unit 20.

Mid-frame 26 provides support for the print media sheet 30 when the print media sheet 30 is in print zone 60, and in part, defines a portion of a print media path 64 of ink jet printer 14.

Feed roller unit 20 includes a feed roller 66 and corresponding index pinch rollers (not shown). Feed roller 66 is driven by a drive unit 68. The index pinch rollers apply a biasing force to hold the print media sheet 30 in contact with respective driven feed roller 66. Drive unit 68 includes a drive source, such as a stepper motor, and an associated drive mechanism, such as a gear train or belt/pulley arrangement. Feed roller unit 20 feeds the print media sheet 30 in a sheet feed direction 70, designated as an X in a circle to indicate that the sheet feed direction is out of the plane of FIG. 1 toward the reader. The sheet feed direction 70 is commonly referred to as the vertical direction, which is perpendicular to the horizontal bi-directional scanning path 44*a*, and in turn, perpendicular to the horizontal carrier scan directions 62, 63. Thus, with respect to print media sheet 30, carrier reciprocation occurs in a horizontal direction and media advance occurs in a vertical direction, and the carrier reciprocation is generally perpendicular to the media advance.

Controller 24 includes a microprocessor having an associated random access memory (RAM) and read only memory (ROM). Controller 24 executes program instructions to effect the printing of an image on the print media sheet 30, such as for example, by selecting the index feed distance of print media sheet 30 along print media path 64 as conveyed by feed roller 66, controlling the reciprocation of printhead carrier 32, and controlling the operations of printheads 34, 36. In addition, controller 24 executes instructions to conduct bi-directional printhead alignment based on information received from sensor 42.

Controller 24 is electrically connected and communicatively coupled to printheads 34, 36 via a communications link 72, such as for example a printhead interface cable. Controller 24 is electrically connected and communicatively coupled to carrier motor 54 via a communications link 74, such as for example an interface cable. Controller 24 is electrically connected and communicatively coupled to drive unit 68 via a communications link 76, such as for example an interface cable. Controller 24 is electrically connected and communicatively coupled to sheet picking unit 22 via a communications link 78, such as for example an interface cable. Controller 24 is electrically connected and communicatively coupled to sensor 42 via a communications link 80, such as for example an interface cable.

Figure 2:
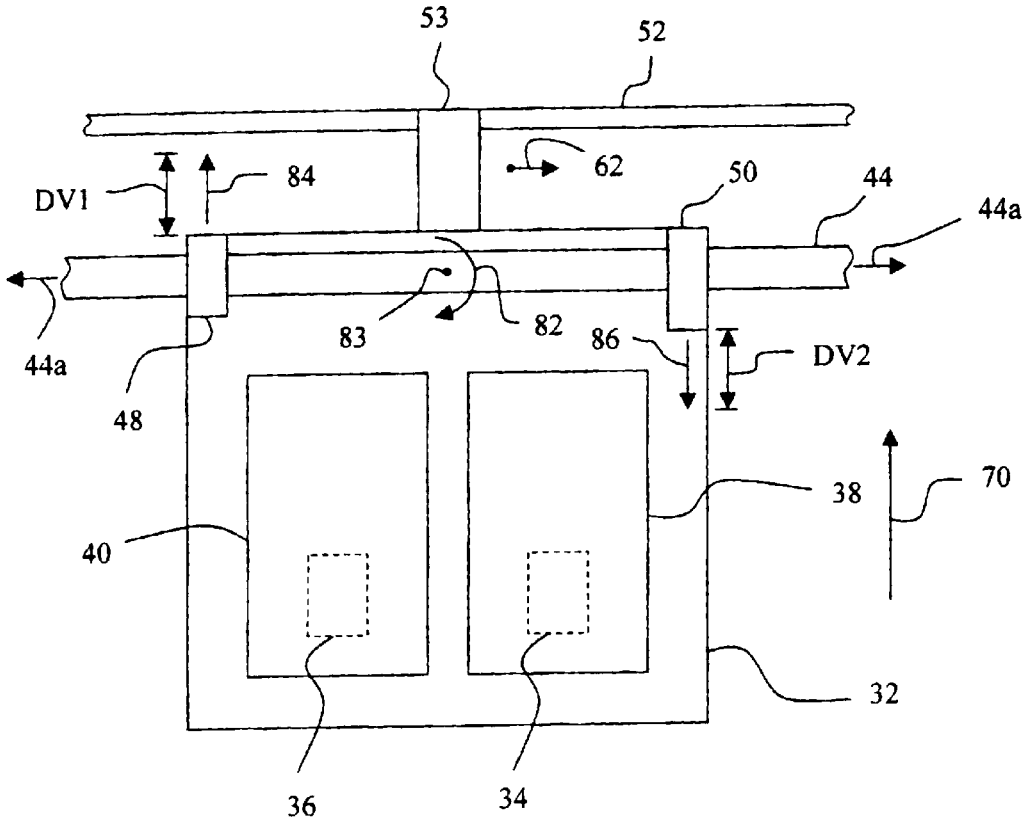
FIG. 2 is a top view of a portion of the ink jet printer illustrated in FIG. 1, depicting a left-to-right carrier scan.

FIG. 2, which a top view of a portion of ink jet printer 14 illustrated in FIG. 1, illustrates how printhead carrier 32 can be cocked during movement of printhead carrier 32 in left-to-right carrier scan direction 62. As carrier belt 52 applies a driving force in left-to-right carrier scan direction 62, a clockwise torque 82 is applied about a moment 83 to printhead carrier 32 and any clearances in guide rod bearings 48, 50 are taken up against guide rod 44, resulting a rotational shift in the vertical position of printhead carrier 32, and in turn, printheads 34, 36. The clearance between guide rod bearings 48, 50 and guide rod 44 may be due to manufacturing tolerances, and may change over time due to wear of the bearing surfaces of guide rod bearings 48, 50 and or wear of the guide surface of guide rod 44. In any event, the clearance in guide rod bearing 48 is taken up resulting in a vertical shift in the position of carrier 32 in vertical direction 84 by a distance DV1; likewise, clearance in guide rod bearing 50 is taken up resulting in a vertical shift in the position of carrier 32 in vertical direction 86 by a distance DV2. The distances DV1 and DV2 are highly exaggerated in FIG. 2 for purposes of illustration.

Figure 3:
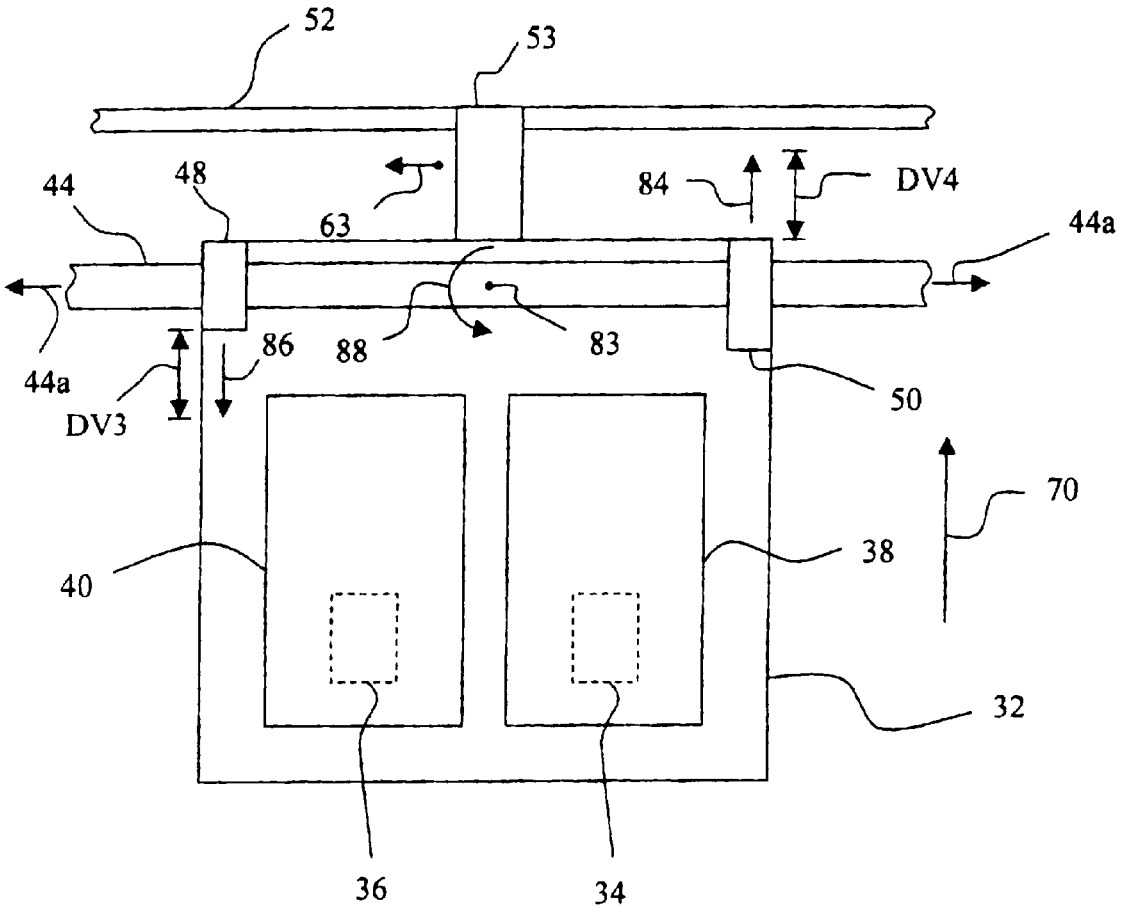
FIG. 3 is a top view of a portion of the ink jet printer illustrated in FIG. 1, depicting a right-to-left carrier scan.

Conversely, FIG. 3, which is also a top view of a portion of ink jet printer 14 illustrated in FIG. 1, illustrates how printhead carrier 32 can be cocked during movement of printhead carrier 32 in right-to-left carrier scan direction 63. As carrier belt 52 applies a driving force in right-to-left carrier scan direction 63, a counter-clockwise torque 88 is applied about moment 83 to printhead carrier 32 and again clearances in guide rod bearings 48, 50 are taken up, resulting a rotational shift in the vertical position of printhead carrier 32, and in turn, printheads 34, 36. Accordingly, clearance in guide rod bearing 48 is taken up resulting in a vertical shift in the position of carrier 32 in vertical direction 86 by a distance DV3; likewise, clearance in guide rod bearing 50 is taken up resulting in a vertical shift in the position of carrier 32 in vertical direction 84 by a distance DV4. The distances DV3 and DV4 are highly exaggerated in FIG. 3 for purposes of illustration.

With reference to FIGS. 2 and 3, it is to be understood that vertical distances DV1, DV2, DV3 and DV4 may be equal, or may be different. However, as is apparent from FIGS. 2 and 3, the application of clockwise torque 82 to printhead carrier 32 and the associated vertical shift of printhead carrier 32 by distances DV1 and DV2 in directions 84 and 86, respectively, or the application of counterclockwise torque 88 to printhead carrier 32 and the associated vertical shift of printhead carrier 32 by distances DV3 and DV4 in directions 86 and 84, respectively, will result in a change in the vertical position of printheads 34, 36 in relation to print media sheet 30, e.g., in the vertical sheet feed direction 70. Also, the direction and/or magnitudes of such shifts in the vertical position of printheads 34, 36 are dependent on the direction of movement of printhead carrier 32, in one of carrier scan direction 62 or carrier scan direction 63. Accordingly, if left uncorrected, such shifts in the vertical position of printheads 34, 36 may result in unacceptable printing defects. The present invention provides methods to reduce printing defects resulting from such shifts in the vertical position of printheads 34, 36.

Figure 4:
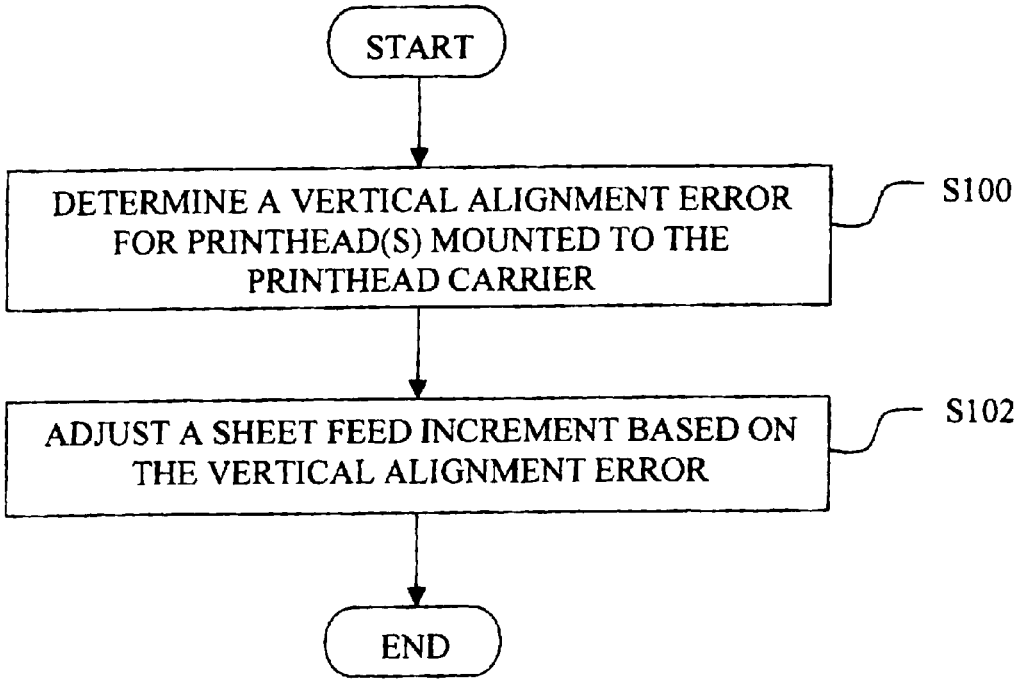
FIG. 4 is a flowchart of a general method in accordance with the present invention.

FIG. 4 shows a flowchart of a general method of reducing printing defects in ink jet printer 14, in accordance with the present invention.

At step S100, a vertical alignment error is determined for printheads 34, 36. While the present embodiment, as discussed with respect to FIGS. 1 and 2, discloses a printhead carrier 32 that carriers two printheads, e.g., printheads 34, 36, those skilled in the art will recognize that the present invention may be adapted to apply to a printhead carrier that carries a single printhead, or a printhead carrier that carries more than two printheads. Step S100 may be performed, for example, by a vertical alignment error determination method implemented as computer instructions executed by controller 24, in conjunction with feedback, e.g., measurements, received from printhead alignment sensor 42. Examples of vertical alignment error determination methods that may be used in determining step S100 are set forth below, and discussed in relation to FIGS. 5 and 7.

At step S102, controller 24 adjusts a sheet feed increment based on the vertical alignment error determined in step S100. For example, controller 24 provides control signals to drive unit 68 via communications link 76, so as to control an amount of rotation of feed roller 66. This amount of rotation of feed roller 66 translates into a sheet feed increment, e.g., a linear distance that print media sheet 30 is advanced in sheet feed direction 70 by a rotation of feed roller 66. An amount of the adjustment of the sheet feed increment may be dependent on a direction of travel of printhead carrier 32, and in turn, printheads 34, 36. For example, a first amount of adjustment of the sheet feed increment may be determined to be appropriate for a next scan of printheads 34, 36 in left-to-right carrier scan direction 62 to compensate for the vertical shifts of printheads 34 and 36 associated with distances DV1 and DV2 of FIG. 2, and a second amount of adjustment of the sheet feed increment may be determined to be appropriate for a subsequent scan of printheads 34, 36 in right-to-left carrier scan direction 63 to compensate for the vertical shifts of printheads 34 and 36 associated with distances DV3 and DV4 of FIG. 3, wherein the first amount of adjustment and the second amount of adjustment may be different.

By way of example, assume a first nominal sheet feed increment for a next scan of printheads 34, 36 in carrier scan direction 62 to be 17/1200ths of an inch and second nominal sheet feed increment for a subsequent scan of printheads 34, 36 in carrier scan direction 63 to be 27/1200ths of an inch. Based on the vertical alignment error determined in step S100, at step S102 one or both of the first nominal sheet feed increment and the second nominal sheet feed increment may be adjusted. Thus, for example, the first sheet feed increment may be changed from the nominal value of 17/1200 to 18/1200, and the second sheet feed increment may be changed from the nominal value of 27/1200 to 25/1200.

Further, it should be noted from FIG. 2 that due to the clockwise torque 82 applied to printhead carrier 32 due movement of printhead carrier 32 in respective carrier scan direction 62, use of printhead 34 may require a positive adjustment to the sheet feed increment and use of printhead 36 may require a negative adjustment to the sheet feed increment. In other words, for a particular carrier scan direction, the direction of adjustment to the sheet feed increment for printhead 34 will be opposite to the direction of adjustment to the sheet feed increment for printhead 36.

Similarly, it should be noted from FIG. 3 that due to the counterclockwise torque 88 applied to printhead carrier 32 due to movement of printhead carrier 32 in respective carrier scan direction 63, use of printhead 34 may require a negative adjustment to the sheet feed increment and use of printhead 36 may require a positive adjustment to the sheet feed increment.

By modifying the sheet feed increment, i.e., the media advance distance, by an amount dependent on the carrier scan direction, the magnitude of the total vertical mis-registration of printheads 34, 36, including the vertical mis-registration due to guide rod bearings 48, 50 of printhead carrier 32, may be minimized.

Figure 5:
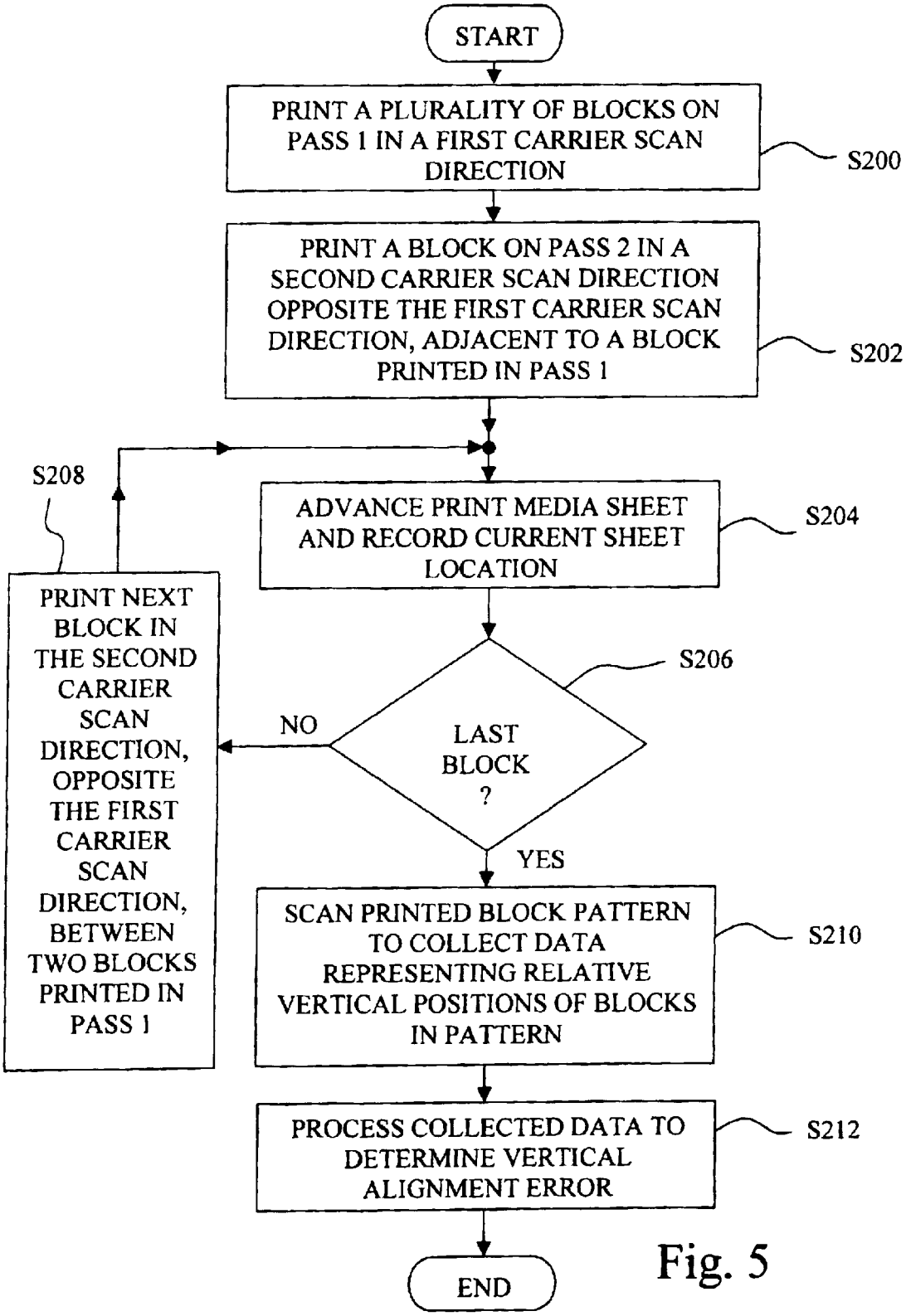
FIG. 5 is a flowchart of one exemplary vertical alignment error determination method in accordance with the present invention.

FIG. 5 is a flowchart of one exemplary vertical alignment error determination method, and is explained below in relation to FIG. 6.

Figure 6:
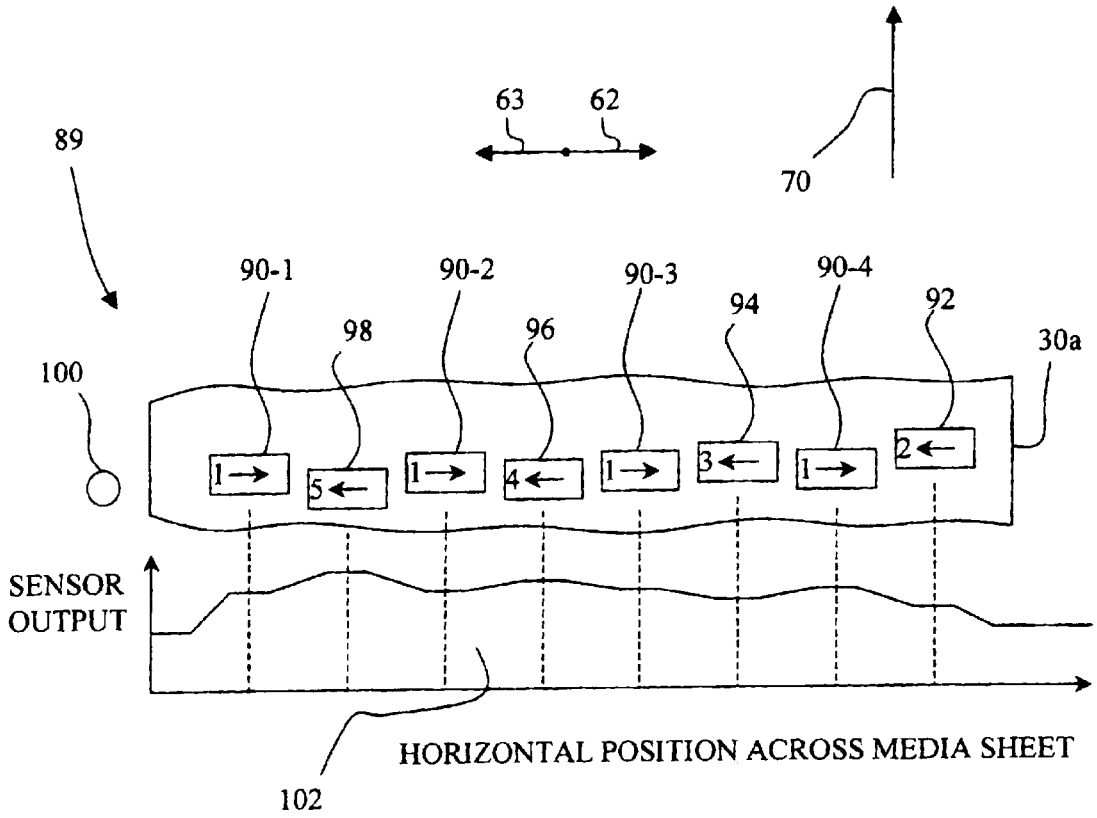
FIG. 6 graphically depicts the printing of a printhead alignment pattern, and the sensing thereof, in accordance with the method of FIG. 5.

FIG. 6 graphically depicts the printing of a bi-directional printhead alignment pattern 89 in accordance with the method of FIG. 5, and includes eight exemplary printed blocks 90-1, 90-2, 90-3, 90-4, 92, 94, 96 and 98. Blocks 90-1, 90-2, 90-3, and 90-4 are printed on a sheet of print media 30*a* in printhead pass 1 in carrier scan direction 62. Block 92 is printed on printhead pass 2 in carrier scan direction 63. Block 94 is printed on printhead pass 3 in carrier scan direction 63. Block 96 is printed on printhead pass 4 in carrier scan direction 63. Block 98 is printed on printhead pass 5 in carrier scan direction 63. A spot size 100 of printhead alignment sensor 42 is also graphically illustrated. There is further shown in FIG. 6 a graph illustrating how the sensor output, e.g., amplitude, of printhead alignment sensor 42 varies across the width of a sheet of print media 30*a* as the printhead alignment sensor 42 crosses printhead alignment pattern 89.

Blocks 90-1, 90-2, 90-3, 90-4, 92, 94, 96 and 98 may be printed by a particular one of printheads 34 and 36, depending upon which printhead is being considered for purposes of vertical alignment. Also, in one embodiment, the same nozzles of the printhead are used to print each block.

Alternatively, for example, in another embodiment vertical alignment between printheads 34 and 36 may be measured, for example, by printing blocks 90-1, 90-2, 90-3 and 90-4 with printhead 34 and by printing each of blocks 92, 94, 96 and 98 with printhead 36.

Referring to FIG. 5, at step S200, a plurality of blocks, e.g., blocks 90-1, 90-2, 90-3 and 90-4 are printed in pass 1 in a first carrier scan direction, e.g., left-to-right carrier scan direction 62, by the respective printhead, e.g., printhead 36. As shown, blocks 90-1, 90-2, 90-3 and 90-4 are spaced apart to permit the insertion of subsequent blocks on respective subsequent scans of the printhead.

At step S202, a block, e.g., block 92, is printed on the sheet of print media 30*a* by the respective printhead, e.g., printhead 36, in pass 2 in a second carrier scan direction opposite to the first carrier scan direction, e.g., in the right-to-left carrier scan direction 63. Block 92 is positioned adjacent to block 90-4 printed in pass 1 in step S200.

At step S204, controller 24 causes the sheet of print media sheet 30*a* to be advanced by a small predetermined advance distance, such as for example 2/1200ths of an inch, and controller 24 records the current media location.

At step S206, it is determined whether the last block, e.g., block 98, has been printed.

If the determination at step S206 is NO, then the process proceeds to step S208.

At step S208, the next block, e.g., block 94, block 96 or block 98, is printed by the respective printhead, e.g., printhead 36, in the second carrier scan direction opposite the first direction, e.g., in right-to-left carrier scan direction 63, between two of the blocks printed in pass 1 in step S200 that were not previously printed between.

The process then returns to step S204, wherein controller 24 again causes the sheet of print media 30*a* to be advanced by the small predetermined advance distance, and controller 24 again records the then current media location.

If the determination at step S206 is YES, then the process proceeds to step S210.

At step S210, controller 24 causes printhead carrier 32 to scan printhead alignment sensor 42, having spot size 100, across the printed pattern 89 in carrier scan direction 62 to collect data representing relative vertical positions of blocks 90-1, 90-2, 90-3, 90-4, 92, 94, 96 and 98 in printed pattern 89.

At step S212, controller 24 processes the collected data to determine a vertical alignment error. Recall that each of blocks 94, 96 and 98 were printed following an advancement of the sheet of print media 30*a*. The graph of FIG. 6 is divided, using dashed lines, into a plurality regions, with each region including one of the blocks 90-1, 90-2, 90-3, 90-4 printed in pass 1 in carrier scan direction 62 and a block printed in carrier scan direction 63. Each region is analyzed to identify the region having the most consistent sensor output values.

Assume, for example, that region 102 is deemed to have the most consistent sensor output values. As such, it has been determined that block 96 printed in carrier scan direction 63 yielded the best vertical alignment with block 90-2 printed in scan direction 62. However, it is further known that the sheet of print media 30*a* was advanced twice by the small predetermined advance distance to yield this best vertical alignment. Accordingly, the number of advances and the advance distance used in generating the positional relationship between blocks 90-2 and 94 may then be used to adjust the sheet feed increment at step S 102 of FIG. 4, i.e., based on the vertical alignment error determined in the method of FIG. 5.

Alternatively, rather than just using the region 102 that is deemed to have the most consistent sensor output values, an approximation may be made by interpolating the portion of the graph in region 102, and correlating the interpolated result with a fractional portion of the total advance distance used in printing block 94 at its respective location.

Figure 7:
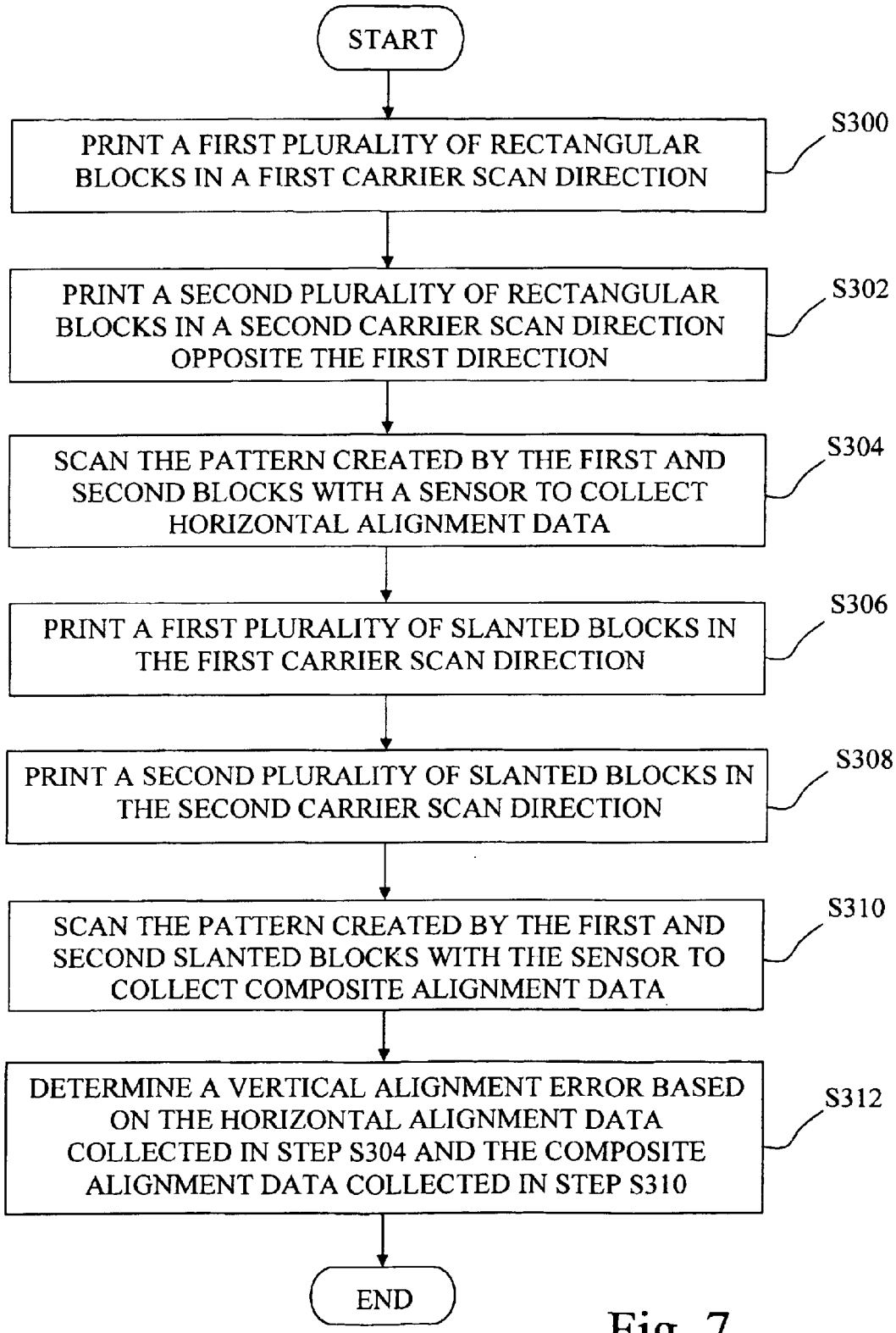
FIG. 7 is a flowchart of another exemplary vertical alignment error determination method in accordance with the present invention.

FIG. 7 is a flowchart of another exemplary vertical alignment error determination method, and is explained below in relation to FIGS. 8A and 8B.

Figure 8A:
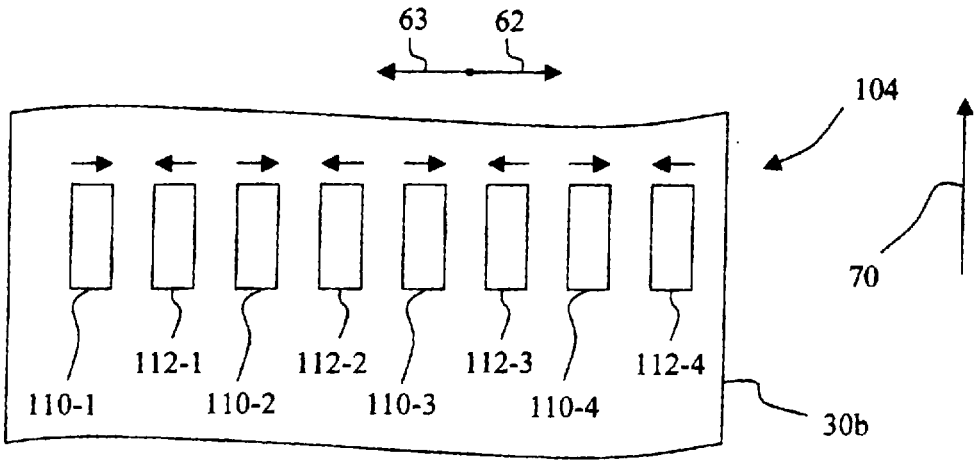
FIGS. 8A and 8B graphically depict the printing of a pair of printhead alignment patterns in accordance with the method of FIG. 7.
Figure 8B:
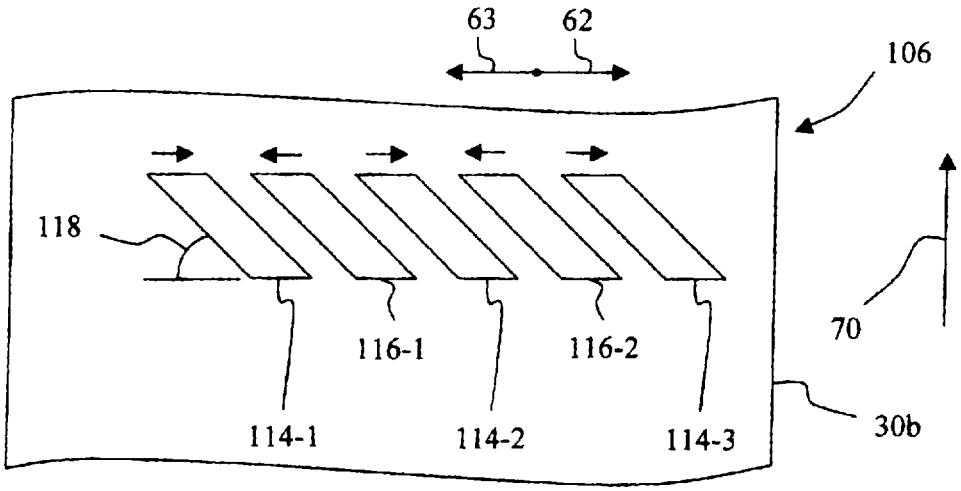

FIGS. 8A and 8B graphically depict the printing of printhead alignment patterns 104 and 106 on the sheet of print media 30*b* in accordance with the method of FIG. 7.

Printhead alignment pattern 104 (see FIG. 8A) includes a plurality of rectangular blocks, and includes eight exemplary printed blocks 110-1, 110-2, 110-3, 110-4, 112-1, 112-2, 112-3, and 112-4. Blocks 110-1, 110-2, 110-3 and 110-4 are printed on left-to-right carrier scan direction 62. Blocks 112-1, 112-2, 112-3 and 112-4 are printed on right-to-left carrier scan direction 63.

Printhead alignment pattern 106 (see FIG. 8B) includes a plurality of slanted parallelogram blocks, and includes five exemplary printed slanted blocks 114-1, 114-2, 114-3, 116-1, and 116-2. Blocks 114-1, 114-2 and 114-3 are printed on left-to-right carrier scan direction 62. Slanted blocks 116-1, and 116-2 are printed on right-to-left carrier scan direction 63.

Referring now to FIG. 7, at step S300, a plurality of blocks, e.g., rectangular blocks 110-1, 110-2, 110-3 and 110-4, are printed in a first pass of the respective printhead, e.g., printhead 34, in left-to-right carrier scan direction 62. As shown, blocks 110-1, 110-2, 110-3 and 110-4 are spaced apart to permit the insertion of subsequent blocks on a subsequent return scan of printhead 34 in right-to-left carrier scan direction 63. Rectangular blocks 110-1, 110-2, 110-3 and 110-4 are positioned to be parallel to vertical direction 70.

At step S302, a plurality of blocks, e.g., rectangular blocks 112-1, 112-2, 112-3 and 112-4 are printed in a second pass of the respective printhead, e.g., printhead 34, in right-to-left carrier scan direction 63. As shown, each blocks 112-1, 112-2, 112-3, 112-4 are printed adjacent respective ones of blocks 110-1, 110-2, 110-3, 110-4, which were spaced apart to permit the insertion of the subsequent blocks, e.g., 112-1, 112-2, 112-3, on the subsequent return scan of printhead 34 in right-to-left carrier scan direction 63. Rectangular blocks 112-1, 112-2, 112-3 and 112-4 are positioned to be parallel to vertical direction 70.

At step S304, printhead alignment sensor 42 is used to scan pattern 104, and controller 24 collects data relating to the horizontal alignment of rectangular blocks 110-1, 110-2, 110-3 and 110-4 in relation to rectangular blocks 112-1, 112-2, 112-3 and 112-4. Since the rectangular blocks of pattern 104 are substantially parallel to vertical direction 70, pattern 104 only includes a horizontal alignment component, and accordingly, the signals received from printhead alignment sensor 42 in scanning pattern 104 includes only horizontal alignment data.

At step S306, a plurality of blocks, e.g., slanted parallelogram blocks 114-1, 114-2 and 114-3 are printed in a third pass of the respective printhead, e.g., printhead 34, in left-to-right carrier scan direction 62. As shown, blocks 114-1, 114-2 and 114-3 are spaced apart to permit the insertion of subsequent blocks on a subsequent return scan of printhead 34 in right-to-left carrier scan direction 63. Slanted parallelogram blocks 114-1, 114-2 and 114-3 are positioned to be non-parallel to vertical direction 70. The angle of the slant is used to establish a ratio between the associated vertical alignment components and the associated horizontal alignment components of the blocks in pattern 106.

The angle of the slant is selected to be less than 90 degrees with respect to vertical direction 70 with reference to horizontal carrier scan directions 62, 63. As shown in FIG. 8B, the angle of the slant, i.e., slant angle 118, may be, for example, in a range of 30 degrees to 60 degrees, and more preferably, about 45 degrees.

At step S308, a plurality of blocks, e.g., slanted parallelogram blocks 116-1 and 116-2 are printed in a fourth pass of the respective printhead, e.g., printhead 34, in right-to-left carrier scan direction 63. As shown, each blocks 116-1 and 116-2 are printed adjacent respective ones of blocks 114-1, 114-2 and 114-3, which were spaced apart to permit the insertion of the subsequent blocks, e.g., 116-1 and 112-2, on the subsequent return scan of printhead 34 in right-to-left carrier scan direction 63. Slanted parallelogram blocks 116-1 and 116-2 are positioned to be non-parallel to vertical direction 70.

At step S310, printhead alignment sensor 42 is used to scan pattern 106, and controller 24 collects composite alignment data relating to the alignment of slanted parallelogram blocks 114-1, 114-2, 114-3 in relation to slanted parallelogram blocks 116-1, 116-2. Since the slanted parallelogram blocks of pattern 106 are substantially non-parallel to vertical direction 70, pattern 106 includes both a horizontal alignment component and a vertical alignment component, and accordingly, the signals received from printhead alignment sensor 42 in scanning pattern 106 represent composite alignment data that includes both a horizontal alignment data component and a vertical alignment data component.

At step S312, a vertical alignment error is determined. For example, controller 24 processes the composite alignment data determined in step S310 and the horizontal alignment data determined in step S304 to generate a vertical alignment value corresponding to the vertical alignment error.

More particularly, controller 24 calculates that vertical alignment error by first scaling the composite alignment data determined in step S310 in relation to the horizontal alignment data determined in step S304. The scaling is performed based on slant angle 118, which also represents a ratio between the vertical and horizontal components in pattern 106. Next, the horizontal alignment data determined in step S304 is subtracted from the scaled composite alignment data, thus leaving only a vertical alignment value corresponding to the vertical alignment component of pattern 106, which in turn is designated as the vertical alignment error.

Accordingly, the vertical alignment error determined in the method of FIG. 7 may then be used in adjusting the sheet feed increment at step S102 of FIG. 4.

Alternatively, the vertical alignment error may be corrected by manipulating data as it is being formatted for printing, such as for example, in the data formatter of a printer driver executed by host 12.

While this invention has been described with respect to exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of reducing printing defects in an ink jet printer including at least one printhead mounted to a printhead carrier for printing on a print media sheet, comprising the steps of:

determining a vertical alignment error for said at least one printhead; and adjusting a sheet feed increment for said print media sheet based on said vertical alignment error, wherein an amount of adjustment of said sheet feed increment is dependent on a direction of travel of said at least one printhead.

2. The method of claim 1, wherein said at least one printhead includes two printheads.

3. The method of claim 1, wherein said determining step is performed by measuring said vertical alignment error using a sensor.

4. The method of claim 1, said determining step including the steps of:

generating a bi-directionally printed pattern; and scanning said bi-directionally printed pattern with a sensor to collect vertical alignment data.

5. A method of reducing printing defects in an ink jet printer including at least one printhead mounted to a printhead carrier for printing on a print media sheet, comprising the steps of:

determining a vertical alignment error for said at least one printhead; and adjusting a sheet feed increment for said print media sheet based on said vertical alignment error, wherein a first amount of adjustment of said sheet feed increment is used when a next scan of said at least one printhead is in a first scan direction, and a second amount of adjustment of said sheet feed increment is used when a subsequent scan of said at least one printhead is in an opposite scan direction, said second amount being different from said first amount.

6. A method of reducing printing defects in an ink jet printer including at least one printhead mounted to a printhead carrier for printing on a print media sheet, comprising the steps of:

determining a vertical alignment error for said at least one printhead; and adjusting a sheet feed increment for said print media sheet based on said vertical alignment error, wherein said at least one printhead includes a first printhead and a second printhead, said method including the further steps of:

making one of a positive adjustment and a negative adjustment to said sheet feed increment when printing with said first printhead in a first scan direction; and making an other of said positive adjustment and said negative adjustment to said sheet feed increment when printing with said second printhead in said first scan direction.

7. A method of reducing printing defects in an ink jet printer including at least one printhead mounted to a printhead carrier for printing on a print media sheet, comprising the steps of:

determining a vertical alignment error for said at least one printhead; and adjusting a sheet feed increment for said print media sheet based on alignment error, said determining step including the steps of:

(a) printing on said sheet of print media a plurality of blocks in a first pass in a first carrier scan direction, said blocks being spaced apart;

(b) printing on said sheet of print media a first block on a second pass in a second carrier scan direction opposite to said first carrier scan direction, and positioned adjacent one of said plurality of blocks printed in said first pass;

(c) advancing said sheet of print media by a predetermined advance distance, and recording a current location of said sheet of print media;

(d) printing on said sheet of print media a next block in said second carrier scan direction between two of said plurality of blocks printed in said first pass that were not previously printed between; and (e) scanning a sensor across a pattern formed by said printing of said plurality of blocks, said printing of said first block and said printing of said next block, to collect data representing relative vertical positions of said plurality of blocks, said first block and said next block.

8. The method of claim 7, further comprising the step of repeating steps (c) and (d) until all blocks to be printed in said second carrier scan direction have been printed for said pattern.

9. A method of reducing printing defects in an ink jet printer including at least one printhead mounted to a printhead carrier for printing on a print media sheet, comprising the steps of:

determining a vertical alignment error for said at least one printhead; and adjusting a sheet feed increment for said print media sheet based on said vertical alignment error, said determining step including the steps of:

defining a vertical sheet feed direction;

printing a first plurality of rectangular blocks in a first pass of a printhead in a first scanning direction, said first plurality of rectangular blocks being spaced apart, said first plurality of rectangular blocks being positioned to be parallel to said vertical sheet feed direction;

printing a second plurality of rectangular blocks in a second pass of said printhead in a second carrier scan direction opposite to said first carrier scan direction, each of said second plurality of rectangular blocks being positioned adjacent respective ones of said first plurality of rectangular blocks, said second plurality of rectangular blocks being positioned to be parallel to said vertical sheet feed direction, said first plurality of rectangular blocks and said second plurality of rectangular blocks forming a first pattern;

scanning said first pattern with a sensor to collect horizontal alignment data relating to a horizontal alignment of said first rectangular blocks in relation to said second rectangular blocks;

printing a first plurality of slanted blocks in a third pass of said printhead in said first carrier scan direction, said first plurality of slanted blocks being positioned to be non-parallel to said vertical sheet feed direction, said first plurality of slanted blocks being spaced apart;

printing a second plurality of slanted blocks in a fourth pass of said printhead in said second carrier scan direction, said second plurality of slanted blocks being positioned to be non-parallel to said vertical sheet feed direction, said first plurality of slanted blocks and said second plurality of slanted blocks forming a second pattern;

scanning said second pattern with said sensor to collect composite alignment data relating to alignment of said first plurality of slanted blocks in relation to said second plurality of slanted blocks, said composite alignment data including both a horizontal alignment data component and a vertical alignment data component;

processing said composite alignment data and said horizontal alignment data to generate a vertical alignment value corresponding to said vertical alignment error.

10. The method of claim 9, further comprising the step of scaling said composite alignment data in relation to said horizontal alignment data.

11. The method of claim 10, wherein said processing step includes the step of subtracting said horizontal alignment data from the scaled composite alignment data.

12. The method of claim 9, wherein an angle of a slant of said first plurality of slanted blocks and said second plurality of slanted blocks is used to establish a ratio between vertical alignment components and horizontal alignment components present in said second pattern.

13. The method of claim 12, wherein said angle of said slant is in a range of 30 degrees to 60 degrees.

14. A method of determining a vertical alignment error for a printhead, comprising the steps of:

(a) printing on a sheet of print media a plurality of blocks in a first pass in a first carrier scan direction, said blocks being spaced apart;

(b) printing on said sheet of print media a first block on a second pass in a second carrier scan direction opposite to said first carrier scan direction, and positioned adjacent one of said plurality of blocks printed in said first pass;

(c) advancing said sheet of print media by a predetermined advance distance, and recording a current location of said sheet of print media;

(d) printing on said sheet of print media a next block in said second carrier scan direction between two of said plurality of blocks printed in said first pass that were not previously printed between; and (e) scanning a sensor across a pattern formed by said printing of said plurality of blocks, said printing of said first block and said printing of said next block, to collect data representing relative vertical positions of said plurality of blocks, said first block and said next block.

15. The method of claim 14, further comprising the step of repeating steps (c) and (d) until all blocks to be printed in said second carrier scan direction have been printed for said pattern.

16. A method of determining a vertical alignment error for a printhead, comprising the steps of:

defining a vertical sheet feed direction;

printing a first plurality of rectangular blocks in a first pass of said printhead in a first scanning direction, said first plurality of rectangular blocks being spaced apart, said first plurality of rectangular blocks being positioned to be parallel to said vertical sheet feed direction;

printing a second plurality of rectangular blocks in a second pass of said printhead in a second carrier scan direction opposite to said first carrier scan direction, each of said second plurality of rectangular blocks being positioned adjacent respective ones of said first plurality of rectangular blocks, said second plurality of rectangular blocks being positioned to be parallel to said vertical sheet feed direction, said first plurality of rectangular blocks and said second plurality of rectangular blocks forming a first pattern;

scanning said first pattern with a sensor to collect horizontal alignment data relating to a horizontal alignment of said first rectangular blocks in relation to said second rectangular blocks;

printing a first plurality of slanted blocks in a third pass of said printhead in said first carrier scan direction, said first plurality of slanted blocks being positioned to be non-parallel to said vertical sheet feed direction, said first plurality of slanted blocks being spaced apart;

printing a second plurality of slanted blocks in a fourth pass of said printhead in said second carrier scan direction, said second plurality of slanted blocks being positioned to be non-parallel to said vertical sheet feed direction, said first plurality of slanted blocks and said second plurality of slanted blocks forming a second pattern;

scanning said second pattern with said sensor to collect composite alignment data relating to alignment of said first plurality of slanted blocks in relation to said second plurality of slanted blocks, said composite alignment data including both a horizontal alignment data component and a vertical alignment data component; and processing said composite alignment data and said horizontal alignment data to generate a vertical alignment value corresponding to said vertical alignment error.

17. The method of claim 16, further comprising the step of scaling said composite alignment data in relation to said horizontal alignment data.

18. The method of claim 17, wherein said processing step includes the step of subtracting said horizontal alignment data from the scaled composite alignment data.

19. The method of claim 16, wherein an angle of a slant of said first plurality of slanted blocks and said second plurality of slanted blocks is used to establish a ratio between vertical alignment components and horizontal alignment components present in said second pattern.

20. The method of claim 19, wherein said angle of said slant is in a range of 30 degrees to 60 degrees.

* * * * *